United States Patent [19]

Siaens et al.

[11] Patent Number: 4,973,878

[45] Date of Patent: Nov. 27, 1990

[54] FILAMENT STRUCTURE AND METHOD OF MAKING SUCH STRUCTURE

[75] Inventors: Gustaaf Siaens; Thomas Clouse, IV, both of Richmond, Ky.; G. George Balog, Cleveland, Ohio

[73] Assignee: North American Philips Lighting Corp., New York, N.Y.

[21] Appl. No.: 384,572

[22] Filed: Jul. 24, 1989

Related U.S. Application Data

[60] Division of Ser. No. 180,664, Mar. 30, 1988, Pat. No. 4,895,540, which is a continuation of Ser. No. 923,258, Oct. 27, 1986, abandoned.

[51] Int. Cl.[5] ..... H01K 1/18

[52] U.S. Cl. ..... 313/278; 313/344; 445/32

[58] Field of Search ..... 313/271, 278, 344; 445/27, 32, 48; 140/71.5

[56] References Cited

U.S. PATENT DOCUMENTS

| | | | |
|---|---|---|---|
| 2,696,849 | 12/1954 | Flaws, Jr. et al. | 140/71.5 |
| 3,271,093 | 9/1966 | Meier | 445/27 |
| 3,466,489 | 9/1969 | Audesse et al. | 313/222 |
| 3,497,753 | 2/1970 | Huston, Jr. | 313/271 |
| 3,850,489 | 11/1974 | Jarc et al. | 445/32 |
| 4,440,646 | 8/1983 | Lohrey | 313/333 |
| 4,556,822 | 12/1985 | Lohrey et al. | 315/67 |

FOREIGN PATENT DOCUMENTS

| | | |
|---|---|---|
| 955971 | 1/1957 | Fed. Rep. of Germany . |
| 22024 | of 1914 | United Kingdom . |

*Primary Examiner*—Kenneth Wieder
*Attorney, Agent, or Firm*—Robert T. Mayer

[57] ABSTRACT

A method of making an axial filament structure for a lamp in which the filament is concentric with the axis of the envelope, wherein a hook-like shape (131) is formed in a support member (117) which stretches the filament to its final turns-per-inch ratio.

2 Claims, 1 Drawing Sheet

FILAMENT STRUCTURE AND METHOD OF MAKING SUCH STRUCTURE

This is a division of application Ser. No. 180,664, filed Mar. 30, 1988, now U.S. Pat. No. 4,895,540, which is a continuation of application Ser. No. 923,258 filed Oct. 27, 1986, now abandoned.

This is an invention in the lamp art. More particularly, it involves a method of making a filament structure and the novel structure made by that method.

In lamps with coiled filaments disposed along the longitudinal axes of the lamps it is common practice to fix each filament to its wire supports at a nominal length. The filament is then stretched to meet its specified turns per inch. In the past, this has led to inconsistency in the pitch of the coils of the filament. Where a pair of coils are too close the lamp filament will burn hotter at that point. This can lead to untimely failure at that point.

One of the objects of the invention is to provide a better filament structure.

One of the features of the invention is that it provides an axial filament which is concentric with the envelope of its lamp throughout the length of the filament.

An advantage of the invention is that it provides an axial filament with constant pitch throughout its length. The invention also provides consistent turns per inch throughout the length of the filament.

In accordance with one aspect of the invention there is provided a filament structure including a coiled filament with two ends and having an axis and a prescribed number of turns. A separate wire support is connected to each of the ends of the filament. One of these wire supports has a leg which is disposed perpendicularly to the axis of the filament. The perpendicularly disposed leg also includes a hook-shaped section formed therein.

In accordance with another aspect of the invention there is provide a method of manufacturing a filament structure. This is done by connecting each end of a coiled filament having an axis and a prescribed number of turns to a separate leg of a wire support. The filament is stretched until its desired turns per inch specification is achieved. While the stretching is being done a U-shaped section is formed in one of said legs.

Other objects features and advantages of the invention will be apparent from the following description and appended claims when considered in conjunction with the accompanying drawing in which:

Figure 1:
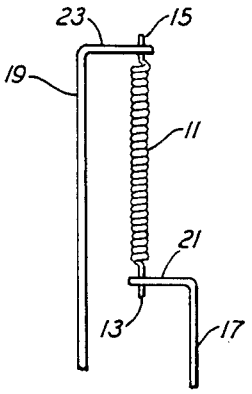
FIG. 1 PRIOR ART
FIG. 1 shows a filament structure before the filament is stretched to its desired turns per inch specification.

Shown in FIG. 1 is a coiled axial filament 11 with ends 13 and 15. Wire supports 17 and 19 are connected to filament ends 13 and 15 respectively in any well known manner, such as by crimping. Wire supports 17 and 19 have legs 21 and 23, respectively, disposed perpendicularly to the longitudinal axis of coil 11.

Figure 2:
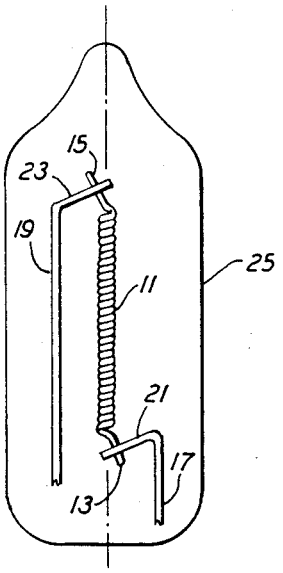
FIG. 2 PRIOR ART
FIG. 2 shows a previous filament structure after stretching to its desired turns_per inch specification located in the envelope of the lamp in which it is provided.

In the prior art, before a filament structure such as that shown in FIG. 1 was inserted into an envelope such as 25 (FIG. 2) of a proposed lamp, legs 21 and/or 23 of wire supports 17 and 19 would be pulled away from each other (as shown in FIG. 2) in order to stretch coil 11 to its intended turns per inch specification. This would cause at least the ends of the filament to be out of concentricity with the axis of the envelope.

Figure 3:
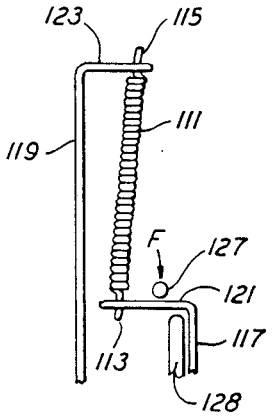
FIG. 3 shows a filament structure in accordance with the invention before stretching together with a part of a jig used in the stretching.
Figure 4:
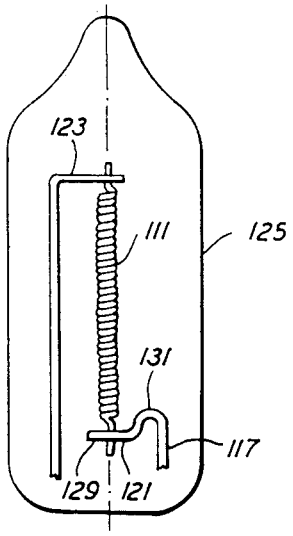
FIG. 4 shows a filament structure in accordance with the invention a stretching located in the envelope of the lamp in which it is provided.

Shown in FIG. 3 is a filament structure to be fashioned in accordance with the invention in an early stage of its manufacture. It consists of coil 111 with ends 113 and 115. These are connected in any suitable manner to legs 121 and 123 of wire supports 117 and 119 respectively. As can be seen leg 121 is provided with a length which renders the axis of filament 111 nonperpendicular to both legs 121 and 123. In the course of manufacture the filament structure shown in FIG. 3 is mounted in a stretching jig which includes pin 127 which is round in cross-section and rod 128. This stretching jig moves legs 121 and 123 away from each other and causes pin 127 to provide a downward force F to leg 121. As a result, coil 111 is stretched to its desired turns per inch specification. If the proper nominal dimensions have been chosen for the filament structure that structure when it is inserted into its envelope 125 (FIG. 4) will have the characteristics shown in FIG. 4. The axis of filament 111 will be concentric throughout its length with the axis of envelope 125. Leg 123 will be disposed substantially perpendicularly to the axes of filament 111 as will end 129 of leg 121. During the stretching, force F applied by pin 127 will cause leg 121 to bend around rod 128 and form a U-shaped hook 131 in wire support 117. As can be seen from FIG. 4, the shape of wire support 117 after the filament structure has been stretched in the stretching jig can be likened to a shepherd's crook.

A filament structure made in accordance with the invention provides a constant pitch axial filament over the length of the filament. It also provides a filament with consistent turns per inch over its length. Such a result may also be obtained notwithstanding modifications to the above-described arrangement and method may be made. For that reason the arrangement and method described herein is for illustrative purposes and is not to be considered restrictive.

What is claimed is:

1. A filament structure including a coiled filament with two ends, a longitudinal axis and a prescribed number of turns, and a separate wire support connected to each of said ends, one of said wire supports having a leg which is disposed perpendicularly to said longitudinal axis, said perpendicularly disposed leg including a U-shaped hook means formed therein, said U-shaped hook means being formed in said leg after said support is connected to said coiled filament to stretch said coiled filament and produce a desired consistent turns per inch specification in said coiled filament.

2. A filament structure as claimed in claim 1, wherein said other wire support also has a leg disposed perpendicularly to said axis.

* * * * *